US010611144B2

(12) United States Patent
Giere et al.

(10) Patent No.: US 10,611,144 B2
(45) Date of Patent: Apr. 7, 2020

(54) FLUID EJECTION DEVICES WITH REDUCED CROSSTALK

(71) Applicant: FUJIFILM Dimatix, Inc., Lebanon, NH (US)

(72) Inventors: Matt Giere, Santa Clara, CA (US); Christoph Menzel, New London, NH (US); Daniel W. Barnett, Plainfield, NH (US)

(73) Assignee: FUJIFILM Dimatix, Inc., Lebannon, NH (US)

( * ) Notice: Subject to any disclaimer, the term of this patent is extended or adjusted under 35 U.S.C. 154(b) by 0 days.

(21) Appl. No.: 16/000,020

(22) Filed: Jun. 5, 2018

(65) Prior Publication Data

US 2018/0354259 A1 Dec. 13, 2018

Related U.S. Application Data

(60) Provisional application No. 62/517,528, filed on Jun. 9, 2017.

(51) Int. Cl.
*B41J 2/045* (2006.01)
*B41J 2/16* (2006.01)
(Continued)

(52) U.S. Cl.
CPC ..... *B41J 2/04525* (2013.01); *B41J 2/055* (2013.01); *B41J 2/1433* (2013.01);
(Continued)

(58) Field of Classification Search
CPC ..... B41J 2/055
See application file for complete search history.

(56) References Cited

U.S. PATENT DOCUMENTS

2014/0022308 A1 1/2014 Gao et al.
2014/0118431 A1 5/2014 Govyadinov et al.
(Continued)

FOREIGN PATENT DOCUMENTS

JP 2017165051 A * 9/2017
JP 2017209821 A * 11/2017
JP 2018154065 A * 10/2018

OTHER PUBLICATIONS

Machine generated, English translation of JP2017165051 to Kumazawa et al., "Inkjet Device, Coating Applicator Using the Same, Application Method"; translation retrieved via espacenet.com on Jul. 16, 2019; 18pp.*

(Continued)

*Primary Examiner* — Shelby L Fidler
(74) *Attorney, Agent, or Firm* — Fish & Richardson P.C.

(57) ABSTRACT

A fluid ejection apparatus includes a fluid ejector comprising a pumping chamber, an ejection nozzle coupled to the pumping chamber, and an actuator configured to cause fluid to be ejected from the pumping chamber through the ejection nozzle. The fluid ejection apparatus includes a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber. A compliance of the first compliant assembly is different from a compliance of the second compliant assembly.

33 Claims, 10 Drawing Sheets

(51) Int. Cl.
*B41J 2/055* (2006.01)
*B41J 2/14* (2006.01)

(52) U.S. Cl.
CPC ..... *B41J 2/14233* (2013.01); *B41J 2/161* (2013.01); *B41J 2/162* (2013.01); *B41J 2/1623* (2013.01); *B41J 2/1626* (2013.01); *B41J 2/1631* (2013.01); *B41J 2/1632* (2013.01); *B41J 2002/14459* (2013.01); *B41J 2202/12* (2013.01)

(56) References Cited

U.S. PATENT DOCUMENTS

| | | | | |
|---|---|---|---|---|
| 2015/0097897 | A1* | 4/2015 | Redding | B41J 2/1433 347/47 |
| 2016/0229186 | A1 | 8/2016 | Kanegae | |
| 2016/0311221 | A1* | 10/2016 | Menzel | B41J 2/1433 |
| 2017/0190179 | A1 | 7/2017 | Menzel et al. | |
| 2019/0001673 | A1* | 1/2019 | Horiuchi | B41J 2/14209 |
| 2019/0047286 | A1* | 2/2019 | Matsuo | B41J 2/14 |

OTHER PUBLICATIONS

PCT International Search Report and Written Opinion of the International Searching Authority, PCT/US2018/036128, dated Aug. 29, 2018, 9 pages.

* cited by examiner

FLUID EJECTION DEVICES WITH REDUCED CROSSTALK

CROSS-REFERENCE TO RELATED APPLICATIONS

This application claims the benefit of priority to U.S. Provisional Application Ser. No. 62/517,528, filed on Jun. 9, 2017, the contents of which are hereby incorporated by reference.

TECHNICAL FIELD

The present disclosure relates generally to fluid ejection devices.

BACKGROUND

In some fluid ejection devices, fluid droplets are ejected from one or more nozzles onto a medium. The nozzles are fluidically connected to a fluid path that includes a fluid pumping chamber. The fluid pumping chamber can be actuated by an actuator, which causes ejection of a fluid droplet. The medium can be moved relative to the fluid ejection device. The ejection of a fluid droplet from a particular nozzle is timed with the movement of the medium to place a fluid droplet at a desired location on the medium. Ejecting fluid droplets of uniform size and speed and in the same direction enables uniform deposition of fluid droplets onto the medium.

SUMMARY

When an actuator of a fluid ejector is activated, a pressure fluctuation can propagate from the pumping chamber into the connected inlet and outlet feed channels. This pressure fluctuation can propagate into other fluid ejectors that are connected to the same inlet or outlet feed channel. This fluidic crosstalk can adversely affect the print quality.

To mitigate the propagation of pressure fluctuations, compliant microstructures can be formed in one or more surfaces of the inlet feed channel, the outlet feed channel, or both. The presence of compliant microstructures in a feed channel increases the compliance available in the surfaces of the feed channel, attenuating the pressure fluctuations that occur in that feed channel. In some examples, the compliant microstructures include nozzle-like structures formed in the bottom surface of the feed channel. When the pressure in the feed channel increases, a meniscus at an outward facing opening of each nozzle-like structure can attenuate the pressure fluctuation. The presence of such compliant microstructures can thus reduce fluidic crosstalk among fluid ejectors connected to the same inlet or outlet feed channel, thus stabilizing the drop size and velocity of the fluid ejected from each fluid ejectors and enabling precise and accurate printing. In some examples, fluid can be ejected through the compliant microstructures during priming of the fluid ejectors. To reduce fluid loss while still allowing the compliant microstructures to mitigate fluidic crosstalk, the arrangement of compliant microstructures in the inlet feed channel can be different from the arrangement of compliant microstructures in the outlet feed channel. For instance, the geometry, number, and/or distribution of compliant microstructures can differ between the inlet feed channel and the outlet feed channel.

In an aspect, a fluid ejection apparatus includes a fluid ejector comprising a pumping chamber, an ejection nozzle coupled to the pumping chamber, and an actuator configured to cause fluid to be ejected from the pumping chamber through the ejection nozzle. The fluid ejection apparatus includes a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber. A compliance of the first compliant assembly is different from a compliance of the second compliant assembly.

Embodiments can include one or more of the following features.

The compliance of the first compliant assembly is less than the compliance of the second compliant assembly. A compliance of the ejection nozzle is greater than the compliance of the first compliant assembly and the compliance of the second compliant assembly. A bubble pressure of the first compliant assembly is greater than a bubble pressure of the ejection nozzle. A bubble pressure of the second compliant assembly is less than a bubble pressure of the ejection nozzle.

The first compliant assembly includes a first compliant nozzle and the second compliant assembly includes a second compliant nozzle. The first compliant nozzle has a different size than the second compliant nozzle. A width of the first compliant nozzle is less than a width of the second compliant nozzle. A length of the first compliant nozzle is greater than a length of the second compliant nozzle. A length of the first compliant nozzle is greater than a width of the first compliant nozzle. The ejection nozzle has a different size than a size of the first compliant nozzle, the second dummy nozzle, or both. A width of the ejection nozzle is greater than a width of the first compliant nozzle and a width of the second compliant nozzle. A length of the ejection nozzle is less than a length of the first compliant nozzle and a length of the second compliant nozzle. The width of the first compliant nozzle is less than the width of the second compliant nozzle. The length of the first compliant nozzle is greater than the length of the second compliant nozzle. The first compliant assembly includes multiple first compliant nozzles and the second compliant assembly includes multiple second compliant nozzles. The number of first compliant nozzles is different from the number of second compliant nozzles. The multiple first compliant nozzles are distributed non-uniformly on the surface of the inlet feed channel and/or the multiple second compliant nozzles are distributed non-uniformly on the surface of the outlet feed channel. A shape of the first compliant nozzle is different from a shape of the second compliant nozzle. The first compliant nozzle defines an inner opening on an internal face of the surface of the inlet feed channel and an outer opening on an external face of the surface of the inlet feed channel. The second compliant nozzle defines an inner opening on an internal face of the surface of the outlet feed channel and an outer opening on an external face of the surface of the outlet feed channel.

The fluid ejection apparatus includes a restriction element formed in a fluidic path between the inlet feed channel and the first compliant assembly. The ejection nozzles are formed in a nozzle layer, and in which the nozzle layer comprises the surface of the inlet channel and the surface of the outlet channel.

In an aspect, a method includes actuating a fluid ejector in a fluid ejection apparatus to cause fluid to be ejected through an ejection nozzle, in which actuating the fluid ejector causes a change in fluid pressure in an inlet feed channel fluidically connected to the fluid ejector and in an outlet feed channel fluidically connected to the fluid ejector; forming a convex meniscus of fluid in a first compliant assembly formed in a surface of the inlet feed channel and in a second compliant assembly formed in a surface of the outlet feed channel responsive to the change in fluid pressure in the inlet feed channel and outlet feed channel. A compliance of the first compliant assembly is different from a compliance of the second compliant assembly.

Embodiments can include one or more of the following features.

The compliance of the first compliant assembly is less than the compliance of the second compliant assembly. Forming the convex meniscus of fluid in the first compliant assembly and the second compliant assembly includes not ejecting fluid from the first compliant assembly or the second compliant assembly. Actuating the fluid ejector causes the fluid pressure in the inlet feed channel to remain below a bubble pressure of the first compliant assembly and causes the fluid pressure in the outlet feed channel to remain below a bubble pressure of the second compliant assembly. The method includes receiving, into the first compliant assembly, the second compliant assembly, or both, fluid disposed on an external face of the surface of the inlet or outlet feed channel.

In an aspect, a method includes forming, in a nozzle layer, an ejection nozzle, a first compliant assembly, and a second compliant assembly, in which a compliance of the first compliant assembly is different from a compliance of the second compliant assembly; and attaching the nozzle layer to a substrate comprising a fluid ejector to form a fluid ejection apparatus, the fluid ejector comprising a pumping chamber and an actuator configured to cause fluid to be ejected from the pumping chamber through the nozzle. In the fluid ejection apparatus, the first compliant assembly is formed in a portion of the nozzle layer that defines a wall of an inlet feed channel fluidically connected to a fluid inlet of the pumping chamber and the second compliant assembly is formed in a portion of the nozzle layer that defines a wall of an outlet feed channel fluidically connected to a fluid outlet of the pumping chamber.

Embodiments can have one or more of the following features.

Forming the first compliant assembly comprises forming a first compliant nozzle through the nozzle layer and in which forming the second compliant assembly comprises forming a second compliant nozzle through the nozzle layer. A length of the first compliant nozzle is greater than a width of the first compliant nozzle. Forming the second compliant nozzle comprises forming a compliant nozzle having a different size than the first compliant nozzle. A width of the first compliant nozzle is less than a width of the second compliant nozzle. A length of the first compliant nozzle is greater than a length of the second compliant nozzle. Forming the first and second compliant nozzles comprises forming compliant nozzles having a different size than the ejection nozzle. Forming the first compliant assembly comprises forming multiple first compliant nozzles through the nozzle layer and in which forming the second compliant assembly comprises forming multiple second compliant nozzles through the nozzle layer, the number of first compliant nozzles being different from the number of second compliant nozzles.

The details of one or more embodiments are set forth in the accompanying drawings and the description below. Other features, aspects, and advantages will become apparent from the description, the drawings, and the claims.

DETAILED DESCRIPTION

Figure 1:
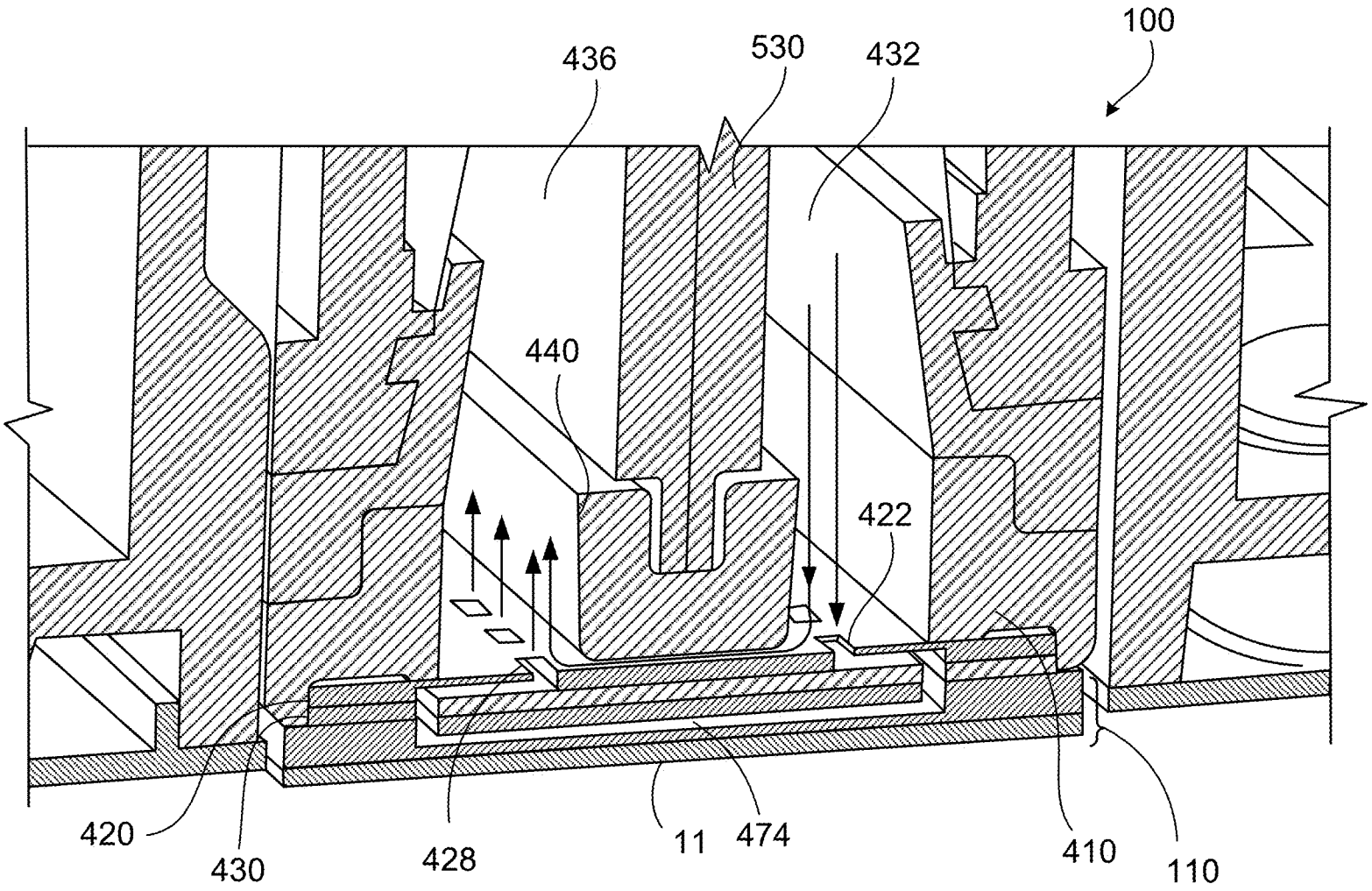
FIG. 1 is a cross sectional view of a printhead.

Referring to FIG. 1, a printhead 100 can be used for ejecting droplets of fluid, such as ink, biological liquids, polymers, liquids for forming electronic components, or other types of fluid, onto a surface. The printhead 100 includes a casing 410 with an interior volume that is divided into a fluid supply chamber 432 and a fluid return chamber 436, e.g., by an upper divider 530 and a lower divider 440.

The bottom of the fluid supply chamber 432 and the fluid return chamber 436 is defined by the top surface of an interposer assembly. The interposer assembly can be attached to a lower printhead casing 410, such as by bonding, friction, or another mechanism of attachment. The interposer assembly can include an upper interposer 420 and a lower interposer 430 positioned between the upper interposer 420 and a substrate 110.

The upper interposer 420 includes a fluid supply inlet 422 and a fluid return outlet 428. For instance, the fluid supply inlet 422 and fluid return outlet 428 can be formed as apertures in the upper interposer 420. A flow path 474 is formed in the upper interposer 420, the lower interposer 430, and the substrate 110. Fluid can flow along the flow path 474 from the supply chamber 432 into the fluid supply inlet 422 and to one or more fluid ejection devices (described in greater detail below) for ejection from the printhead 100. Fluid can also flow along the flow path 474 from one or more fluid ejection devices into the fluid return outlet 428 and into the return chamber 436. In FIG. 1, a single flow path 474 is shown as a straight passage for illustrative purposes; however, the printhead 100 can include multiple flow paths 474, and the flow paths 474 are not necessarily straight.

Figure 2:
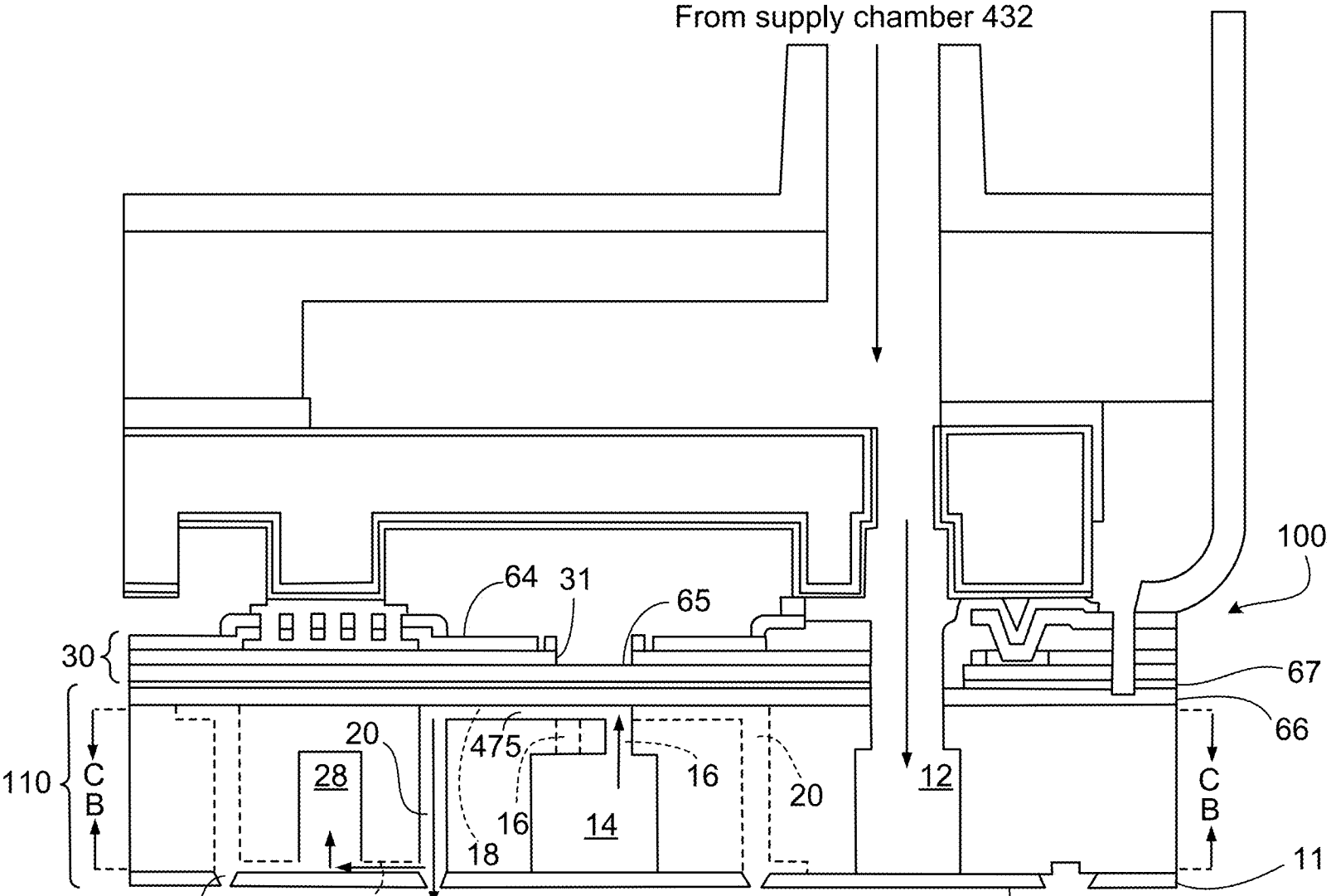
FIG. 2 is a cross sectional view of a portion of a printhead.

Referring to FIG. 2, the substrate 110 can be a monolithic semiconductor body, such as a silicon substrate. Passages through the substrate 110 define a flow path for fluid through the substrate 110. In particular, a substrate inlet 12 receives fluid from the supply chamber 432, extends through a membrane 66 (discussed in more detail below), and supplies fluid to one or more inlet feed channels 14. Each inlet feed channel 14 supplies fluid to multiple fluid ejectors 150 through a corresponding inlet passage (not shown). For simplicity, only one fluid ejector 150 is shown in FIG. 2. Each fluid ejector includes a nozzle 22 formed in a nozzle layer 11 that is disposed on a bottom surface of the substrate 110. In some examples, the nozzle layer 11 is an integral part of the substrate 110; in some examples, the nozzle layer 11 is a layer that is deposited onto the surface of the substrate 110. Fluid can be selectively ejected from the nozzle 22 of one or more of the fluid ejectors 150 to print onto a surface.

Fluid flows through each fluid ejector 150 along an ejector flow path 475. The ejector flow path 475 can include a pumping chamber 18 that is fluidically connected to the inlet feed channel 14 by an ascender 16. The ejector flow path 475 can also include a descender 20 that fluidically connects the pumping chamber 18 to the corresponding nozzle 22. An outlet passage 26 connects the descender 20 to an outlet feed channel 28, which is in fluidic connection with the return chamber 436 through a substrate outlet (not shown). We sometimes refer to the inlet feed channel 14 and the outlet feed channel 28 generally as feed channels 14, 28.

In the example of FIG. 2, passages such as the substrate inlet 12, the inlet feed channel 14, and the outlet feed channel 28 are shown in a common plane. In some examples, one or more of the substrate inlet 12, the inlet feed channel 14, and the outlet feed channel 28 are not in a common plane with one or more of the other passages.

The substrate includes multiple fluid ejectors 150. Fluid flows through each fluid ejector 150 along a corresponding ejector flow paths 475, which includes an ascender 16, a pumping chamber 18, and a descender 20. Each ascender 16 fluidically connects one of the inlet feed channels 14 to the corresponding pumping chamber 18. The pumping chamber 18 is fluidically connected to the corresponding descender 20, which leads to the associated nozzle 22. Each descender 20 is also connected to one of the outlet feed channels 28 through the corresponding outlet passage 26.

Figure 3A:
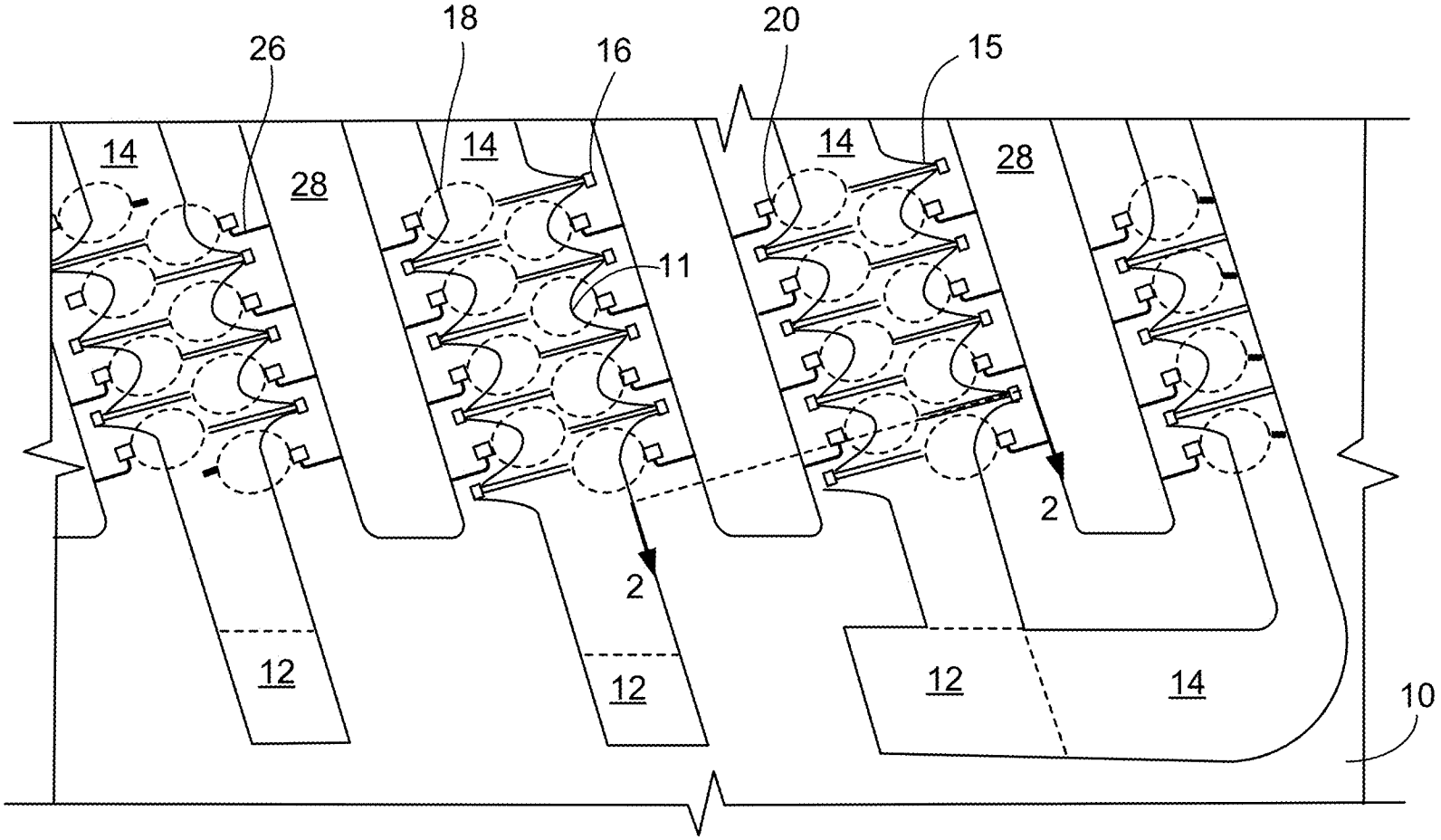
FIG. 3A is a cross sectional view of a portion of the printhead taken along line B-B in FIG. 2.
Figure 3B:
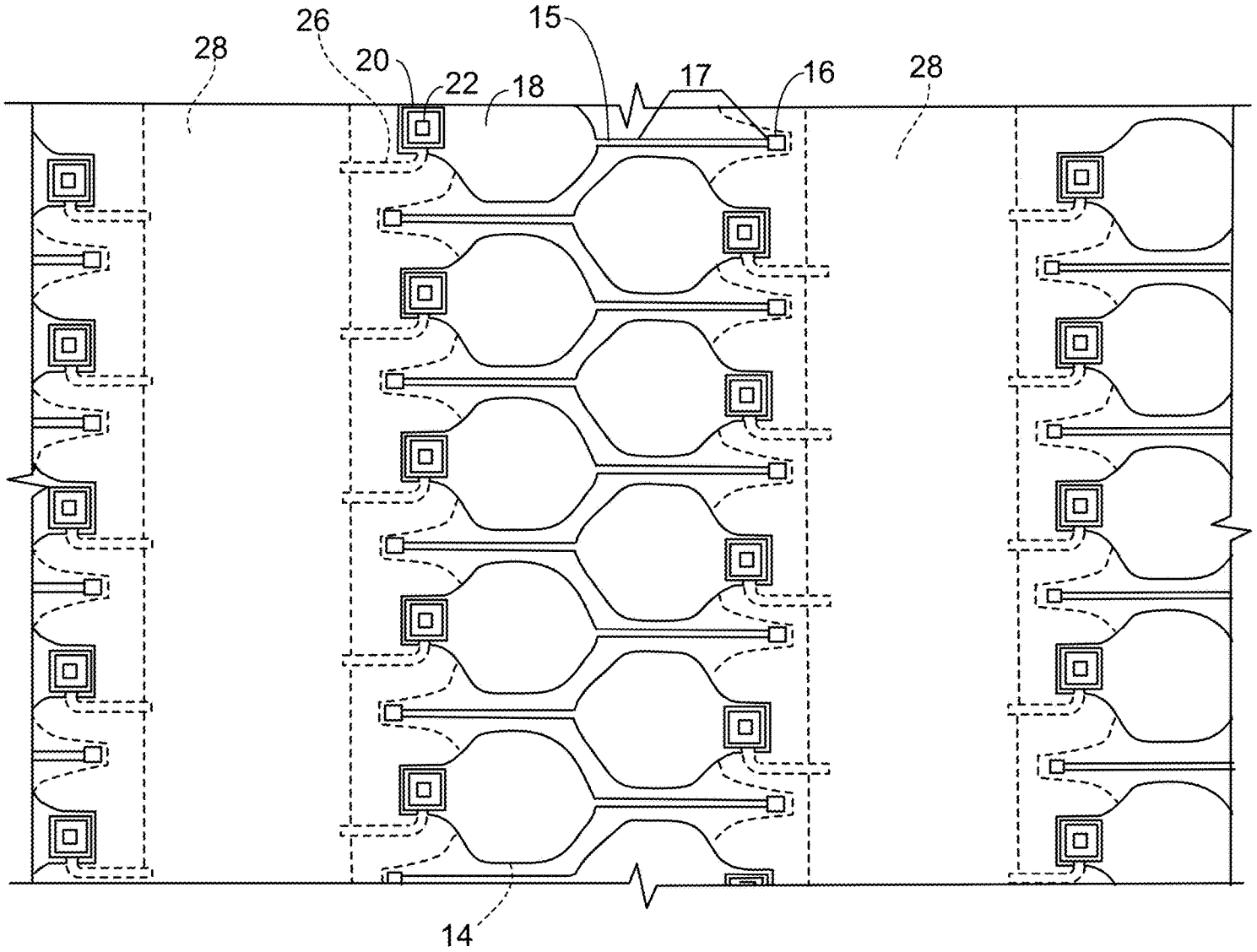
FIG. 3B is a cross sectional view of a portion of the printhead taken along line C-C in FIG. 2.

Referring to FIGS. 3A and 3B, the substrate 110 includes multiple inlet feed channels 14 formed therein and extending parallel with one another. Each inlet feed channel 14 is in fluidic communication with at least one substrate inlet 12 that extends perpendicular to the inlet feed channels 14. The substrate 110 also includes multiple outlet feed channels 28 formed therein and extending parallel with one another. Each outlet feed channel 28 is in fluidic communication with at least one substrate outlet (not shown) that extends perpendicular to the outlet feed channels 28. In some examples, the inlet feed channels 14 and the outlet feed channels 28 are arranged in alternating rows.

In some examples, the printhead 100 includes multiple nozzles 22 arranged in parallel rows. The nozzles 22 in a given row can be all fluidically connected to the same inlet feed channel 14 and the same outlet feed channel 28. As a result, all of the ascenders 16 in a given row can be connected to the same inlet feed channel 14 and all of the descenders in a given row can be connected to the same outlet feed channel 28. In some examples, nozzles 22 in adjacent rows can all be fluidically connected to the same inlet feed channel 14 or the same outlet feed channel 28, but not both. In some examples, rows of nozzles 22 can be connected to the same inlet feed channel 14 or the same outlet feed channel 28 in an alternating pattern. Further details about the printhead 100 can be found in U.S. Pat. No. 7,566,118, the entire contents of which are incorporated here by reference.

The particular flow path configuration described here is an example of a flow path configuration. The approaches described here can also be used in other flow path configurations.

Referring again to FIG. 2, each fluid ejector 150 includes a corresponding actuator 30, such as a piezoelectric transducer or a resistive heater. The pumping chamber 18 of each fluid ejector 150 is in close proximity to the corresponding actuator 30. Each actuator 30 can be selectively actuated to pressurize the corresponding pumping chamber 18, thus ejecting fluid from the nozzle 22 that is connected to the pressurized pumping chamber.

In some examples, the actuator 30 can include a piezoelectric layer 31, such as a layer of lead zirconium titanate (PZT). The piezoelectric layer 31 can have a thickness of about 50 μm or less, e.g., about 1 μm to about 25 μm, e.g., about 2 μm to about 5 μm. In the example of FIG. 2, the piezoelectric layer 31 is continuous. In some examples, the piezoelectric layer 31 can be made discontinuous, e.g., by an etching or sawing step during fabrication. The piezoelectric layer 31 is sandwiched between a drive electrode 64 and a ground electrode 65. The drive electrode 64 and the ground electrode 65 can be metal, such as copper, gold, tungsten, indium-tin-oxide (ITO), titanium, platinum, or a combination of metals. The thickness of the drive electrode 64 and the ground electrode 65 can be, e.g., about 2 μm or less, e.g., about 0.5 μm.

A membrane 66 is disposed between the actuator 30 and the pumping chamber 18 and isolates the ground electrode 65 from fluid in the pumping chamber 18. In some examples, the membrane 66 is a separate layer; in some examples, the membrane is unitary with the substrate 110. In some examples, the actuator 30 does not include a membrane 66, and the ground electrode 65 is formed on the back side of the piezoelectric layer 31 such that the piezoelectric layer 31 is directly exposed to fluid in the pumping chamber 18.

To actuate the piezoelectric actuator 30, an electrical voltage can be applied between the drive electrode 64 and the ground electrode 65 to apply a voltage to the piezoelectric layer 31. The applied voltage causes the piezoelectric layer 31 to deflect, which in turn causes the membrane 66 to deflect. The deflection of the membrane 66 causes a change in volume of the pumping chamber 18, producing a pressure pulse (also referred to as a firing pulse) in the pumping chamber 18. The pressure pulse propagates through the descender 20 to the corresponding nozzle 22, thus causing a droplet of fluid to be ejected from the nozzle 22.

The membrane 66 can formed of a single layer of silicon (e.g., single crystalline silicon), another semiconductor material, one or more layers of oxide, such as aluminum oxide (AlO2) or zirconium oxide (ZrO2), glass, aluminum nitride, silicon carbide, other ceramics or metals, silicon-on-insulator, or other materials. For instance, the membrane 66 can be formed of an inert material that has a compliance such that the actuation of the actuator 30 causes flexure of the membrane 66 sufficient to cause a droplet of fluid to be ejected. In some examples, the membrane 66 can be secured to the actuator 30 with an adhesive layer 67. In some examples, two or more of the substrate 110, the nozzle layer 11, and the membrane 66 can be formed as a unitary body.

In some cases, when the actuator 30 of one of the fluid ejectors 150 is actuated, a pressure fluctuation can propagate through the ascender 16 of the fluid ejector 150 and into the inlet feed channel 14. Likewise, energy from the pressure fluctuation can propagate through the descender 20 of the fluid ejector 150 and into the outlet feed channel 28. Pressure fluctuations can thus develop in one or more of the feed channels 14, 28, that are connected to an actuated fluid ejector 150. In some cases, these pressure fluctuations can propagate into the ejector flow paths 475 of other fluid ejectors 150 that are connected to the same feed channel 14, 28. These pressure fluctuations can adversely affect the drop volume and/or the drop velocity of drops ejected from those fluid ejectors 150, degrading print quality. For instance, variations in drop volume can cause the amount of fluid that is ejected to vary, and variations in drop velocity can cause the location where the ejected drop is deposited onto the printing surface to vary. The inducement of pressure fluctuations in fluid ejectors is referred to as fluidic crosstalk.

In some examples, fluidic crosstalk can be caused by slow dissipation of the pressure fluctuations in the feed channels 14, 28. In some examples, fluidic crosstalk can be caused by standing waves that develop in the feed channels 14, 28. For instance, a pressure fluctuation that propagates into a feed channel 14, 28 when the actuator 30 of one of the fluid ejectors 150 is actuated can develop into a standing wave. When fluid ejection occurs at a frequency that reinforces the standing wave, the standing wave in the feed channel 14, 28 can cause pressure oscillations to propagate into the ejector flow paths 475 of other fluid ejectors 150 connected to the same feed channel 14, 28, causing fluidic crosstalk among those fluid ejectors 150.

Fluidic crosstalk can also be caused by a sudden change in fluid flow through the feed channels 14, 28. In general, when a fluid in motion in a flow channel is forced to stop or change direction suddenly, a pressure wave can propagate in the flow channel (sometimes referred to as the "water hammer" effect). For instance, when one or more fluid ejectors 150 connected to the same feed channel 14, 28 are suddenly turned off, the water hammer effect causes a pressure wave to propagate into the flow channel 14, 28. That pressure wave can further propagate into the ejector flow paths 475 of other fluid ejectors 150 that are connected to the same feed channel 14, 28, causing fluidic crosstalk among those fluid ejectors 150.

Fluidic crosstalk can be reduced by providing greater compliance in the fluid ejectors to attenuate the pressure fluctuations. By increasing the compliance available in the fluid ejectors, the energy from a pressure fluctuation generated in one of the fluid ejectors can be attenuated, thus reducing the effect of the pressure fluctuation on the neighboring fluid ejectors. Compliance in a fluid ejector and its associated fluid flow passages is available in the fluid, the meniscus at the nozzle, and the surfaces of the fluid flow passages (e.g., the inlet feed channel 14, the ascender 16, the descender 20, the outlet passage 26, the outlet feed channel 28, and other fluid flow passages). Increasing the compliance in a fluid ejector 150 and its associated fluid flow passages can help to mitigate fluidic crosstalk among fluid ejectors 150. By increasing the available compliance, the propagation of a pressure fluctuation from a particular fluid ejector 150 to a neighboring fluid ejector 150 can be attenuated within the fluid ejector 150 or the feed channels 14, 28 to which the fluid ejector 150 is connected, thus reducing the effect of that pressure fluctuation on other fluid ejectors 150. For instance, the compliance of a feed channel 14, 28 can be increased to mitigate fluidic crosstalk among fluid ejectors 150 connected to that feed channel 14, 28.

Figure 4:
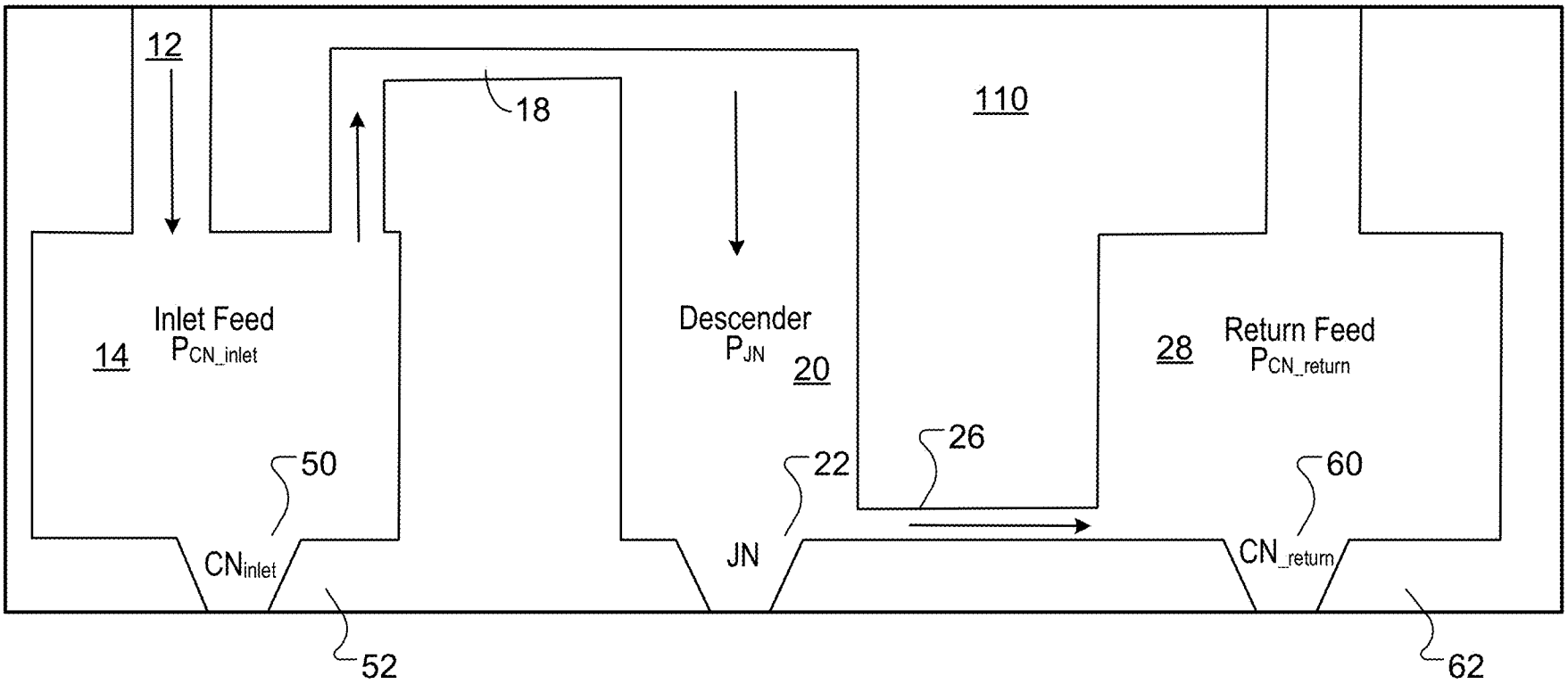
FIG. 4 is a diagram of a fluid ejector.

Referring to FIG. 4, compliance can be added to the inlet feed channel 14 and the outlet feed channel 28 by forming inlet compliant microstructures 50 on one or more surfaces of the inlet feed channel 14 and/or outlet compliant microstructures 60 on one or more surfaces of the outlet feed channel 28. In the example of FIG. 4, inlet compliant microstructures 50 are formed in a bottom surface 52 of the inlet feed channel 14 and outlet compliant microstructures 60 are formed in a bottom surface 54 of the outlet feed channel 28. In this example, the bottom surfaces 52, 54 are formed by the nozzle layer 11. The additional compliance provided by the inlet and outlet compliant microstructures 50, 60 in the corresponding feed channel 14, 28 attenuates the energy from a pressure fluctuation in a particular fluid ejector 150 that is connected to that feed channel 14, 28. As a result, the effect of that pressure fluctuation on other fluid ejectors 150 connected to those same feed channels 14, 28 can be reduced.

In some examples, the compliant microstructures 50, 60 can be nozzle-like structures formed in the nozzle layer 11 of the inlet feed channel 14 and the outlet feed channel 28. We sometimes refer to the nozzle-like compliant microstructures 50, 60 as compliant nozzles. (For clarity, we sometimes refer to the nozzles 22 of the fluid ejectors 150 as jetting nozzles.) The compliant nozzles 50, 60 are located in the feed channels 14, 28, respectively, are not directly connected to or associated with any individual fluid ejector 150 and do not have corresponding actuators. The fluid pressure in the feed channels 14, 28 is generally not high enough to cause fluid to be ejected from the compliant nozzles 50, 60 during normal operation of the fluid ejectors 150. For instance, the fluid ejectors 150 can operate at an ejection pressure of a few atmospheres (e.g., about 1-10 atm) and a threshold pressure for ejection from the compliant nozzles 50, 60 can be about half of the operating pressure.

The compliant nozzles 50, 60 extend through the entire thickness of the nozzle layer 11 and provide a free surface that increases the compliance of the nozzle layer 11. A meniscus of fluid is formed at the opening of each compliant nozzle 50, 60. In some examples, the meniscus is a convex meniscus that bulges out. In some examples, the feed channel 14, 28 can be negatively pressurized such that, in the absence of a pressure fluctuation, the meniscus is drawn inward, e.g., as a concave meniscus). When a pressure fluctuation propagates into the feed channel 14, 28, the meniscus bulges out into a convex meniscus, attenuating the pressure fluctuation and mitigating fluidic crosstalk among neighboring fluid ejectors 150 connected to that feed channel 14, 28.

Further description of compliant nozzles and other compliant microstructures, such as membrane-covered recesses, can be found in U.S. application Ser. No. 14/695,525, filed on Apr. 24, 2015, the entire contents of which are incorporated here by reference.

In some examples, the fluid ejectors 150 can be purged at high fluid pressure, e.g. to clean the fluid flow passages or the jetting nozzles 22. This purging process is sometimes referred to as priming. The high fluid pressure during priming can cause fluid to be ejected through the compliant nozzles 50, 60. This ejection of fluid during priming can be wasteful and can cause fluid to accumulate on the outward facing surface of the nozzle layer 11.

To reduce ink loss through the compliant nozzles 50, 60 during priming, the compliant nozzles 50, 60 can be designed to have a bubble pressure that is higher than the fluid pressure during priming. The bubble pressure of a nozzle is the pressure above which the meniscus of fluid in the nozzle breaks, resulting in the establishment of a flow of ink through the nozzle. When the bubble pressure of the compliant nozzles 50, 60 is greater than the fluid pressure during priming, the meniscus of the fluid in the compliant nozzles will remain intact during priming, thus reducing fluid waste and helping to maintain cleanliness of the outward facing surface of the nozzle layer 11.

Figure 5:
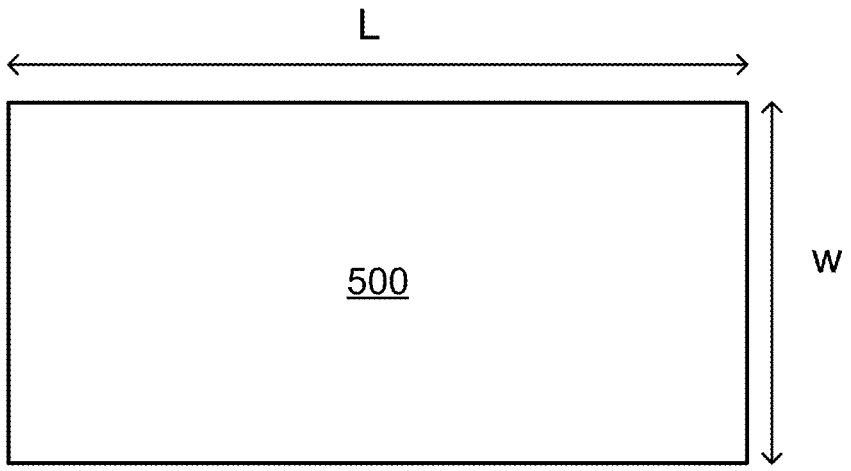
FIG. 5 is a diagram of a rectangular nozzle.

The bubble pressure of a nozzle is dependent on the geometry of the nozzle, such as the size and shape of the nozzle. Referring to FIG. 5, for a rectangular nozzle 500, the bubble pressure is inversely proportional to the smaller dimension of the nozzle (referred to as the width):

$$\text{Bubble pressure} \propto \gamma / w$$

where $\gamma$ is the surface tension of the fluid and w is the width of the rectangular nozzle 500. A narrower rectangular nozzle thus has higher bubble pressure than a wider nozzle, regardless of the length of the nozzle.

The compliance of a nozzle is also dependent on the geometry of the nozzle, such as the size and shape of the nozzle. Referring still to FIG. 5, the compliance of a rectangular nozzle 500 is proportional to the larger dimension of the nozzle (referred to as the length) and to the cube of the width of the nozzle:

$$\text{Compliance} \propto \gamma \cdot L \cdot w^3$$

where L is the length of the rectangular nozzle.

As can be seen from the geometric dependence of the bubble pressure and compliance of a nozzle, designing a nozzle to achieve a desired bubble pressure can affect the compliance of the nozzle, which in turn can affect how effectively the nozzle can mitigate fluidic crosstalk. However, the bubble pressure and the compliance of a nozzle on the can be separately tuned because of the opposite dependence on the width of the nozzle and because only the compliance is a function of the length of the nozzle. The ability to separately tune bubble pressure and compliance enables nozzles to be designed that both have sufficient compliance to mitigate fluidic crosstalk and have a high enough bubble pressure to reduce ink loss during priming.

In an example, one or more long, narrow rectangular compliant nozzles can be formed in the inlet and/or outlet feed channels of a fluid ejector. The narrow width of the compliant nozzles can give the nozzles a bubble pressure that is higher than the fluid pressure of priming. The increased length of the compliant nozzles can at least partially compensate for the loss of compliance due to the narrow width. In some examples, to introduce additional compliance to the inlet and/or outlet feed channels, multiple long, narrow rectangular compliant nozzles can be formed. Compliance is an additive property and thus the presence of additional compliant nozzles can increase the overall compliance of the inlet and/or outlet feed channels without affecting the bubble pressure of the individual compliant nozzles.

In some examples, the geometry and/or number of inlet compliant nozzles formed in the inlet feed channel can be different from the geometry and/or number of outlet compliant nozzles formed in the outlet feed channel. These differences can be useful, e.g., to address different fluid pressures in the inlet feed channel and the outlet feed channel. For instance, the inlet compliant nozzles can be longer and narrower than the outlet compliant nozzles, or the outlet compliant nozzles can be longer and narrower than the inlet compliant nozzles.

Figure 6:
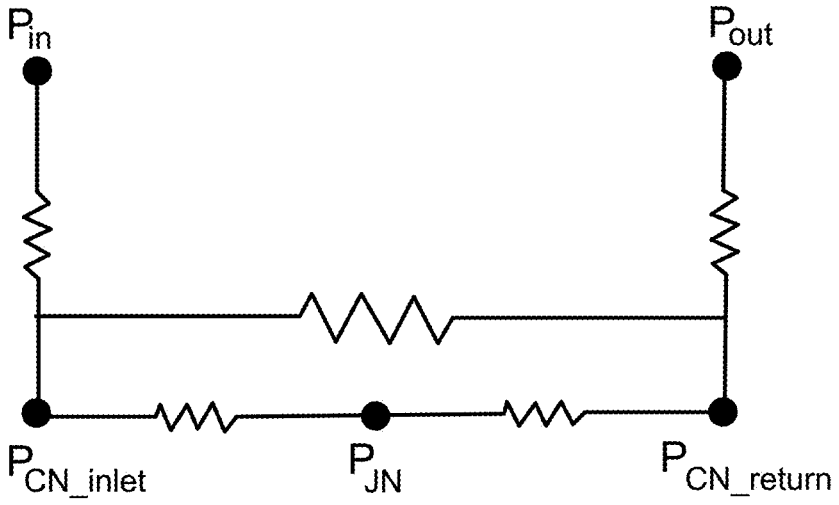
FIG. 6 is a schematic diagram of a fluidic circuit.

Referring to FIGS. 4 and 6, a schematic diagram of a fluidic circuit represents the flow path of fluid through a fluid ejector during printing. Fluid flows into the inlet feed channel at a fluid pressure $P_{in}$. As the fluid flows through the inlet feed channel, fluidic resistance causes the fluid pressure to drop. At the inlet compliant nozzles, the fluid pressure in the inlet feed channel is $P_{cn_inlet}$. At the jetting nozzle, the fluid pressure is $P_{jn}$. At the outlet compliant nozzles, the fluid pressure in the outlet feed channel is $P_{cn_return}$. When the fluid exits the fluid ejector through the outlet feed channel, the fluid is at a fluid pressure $P_{out}$.

From the fluidic circuit, it can be seen that $$P_{in} > P_{CN_inlet} > P_{JN} > P_{CN_return} > P_{out}$$

It follows that, to avoid fluid loss from both the inlet and outlet compliant nozzles during priming, the inlet compliant nozzles can be designed to have a bubble pressure that is greater than the bubble pressure of the outlet compliant nozzles. This difference in bubble pressure can be achieved by forming the inlet compliant nozzles with a different size or shape from the size or shape of the outlet compliant nozzles. For instance, the inlet compliant nozzles can be narrower than the outlet compliant nozzles, thus giving the inlet compliant nozzles a higher bubble pressure than the outlet compliant nozzles. To compensate for the loss of compliance that occurs with decreased width, the inlet compliant nozzles can also be made longer than the outlet compliant nozzles.

In some examples, the number of inlet compliant nozzles can be different from the number of outlet compliant nozzles. For instance, a fluid ejector can have more inlet compliant nozzles than outlet compliant nozzles, or can have more outlet compliant nozzles than inlet compliant nozzles. In some cases, a fluid ejector can have only inlet compliant nozzles and no outlet compliant nozzles, or can have only outlet compliant nozzles and no inlet compliant nozzles.

In some examples, fluidic crosstalk is communicated primarily through only one of the feed channels of a fluid ejector, such as only through the inlet feed channel or only through the outlet feed channel. For instance, in some fluid ejector designs, fluidic crosstalk occurs primarily through the outlet feed channel. In these designs, the outlet compliant nozzles can be designed with a lower bubble pressure (because of the lower fluid pressure in the outlet feed channel) and a higher compliance (because of the occurrence of crosstalk) than the inlet compliant nozzles. In other fluid ejector designs in which fluidic crosstalk occurs primarily through the inlet feed channel of a fluid ejector, the inlet compliant nozzles can be designed with a higher bubble pressure and a higher compliance than the outlet compliant nozzles.

The actual sizes of the inlet and outlet compliant nozzles can be determined based on characteristics of the fluid ejector and the fluid, such as the priming pressure, internal resistances along the flow path, the size of the jetting nozzle, the surface tension of the fluid, and/or other characteristics.

Referring to FIGS. 7A-7E, in a specific example, various configurations of inlet and outlet compliant nozzles were fabricated in fluid ejectors having otherwise similar geometries, including similarly sized and shaped jetting nozzles and similarly sized and shaped inlet and outlet feed channels. FIGS. 7A-7E show bottom views of the nozzle layer for a single fluid ejector for each nozzle configuration. The dimensions of the jetting and compliant nozzles for each configuration are given in Table 1. In the fluid ejectors of this example, fluidic crosstalk is communicated primarily through the outlet feed channel. The crosstalk performance and the volume of fluid ejected during priming were evaluated qualitatively for each configuration.

Figure 7A:
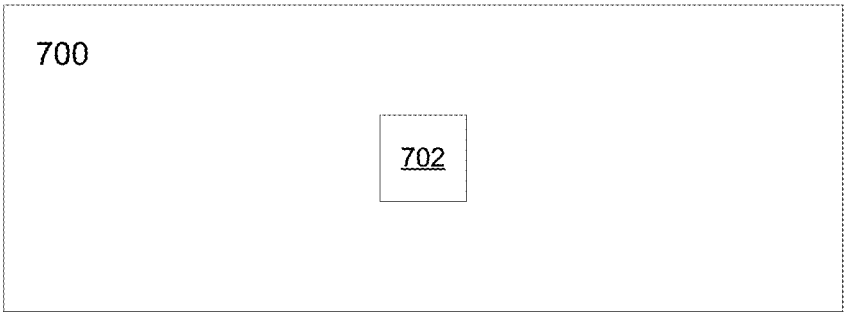
FIGS. 7A-7E are diagrams of example fluid ejectors.

Referring to FIG. 7A, a first configuration of a fluid ejector 700 includes a jetting nozzle 702 but no inlet or outlet compliant nozzles. The crosstalk performance of the fluid ejector 700 was poor, which is consistent with the understanding that the presence of compliant nozzles in the inlet and/or outlet feed channels increases the compliance in the feed channels, thus mitigating the effects of fluidic crosstalk. A negligible volume of fluid was lost during priming, which is expected given that the fluid ejector 700 does not include compliant nozzles from which fluid can be lost.

Figure 7B:
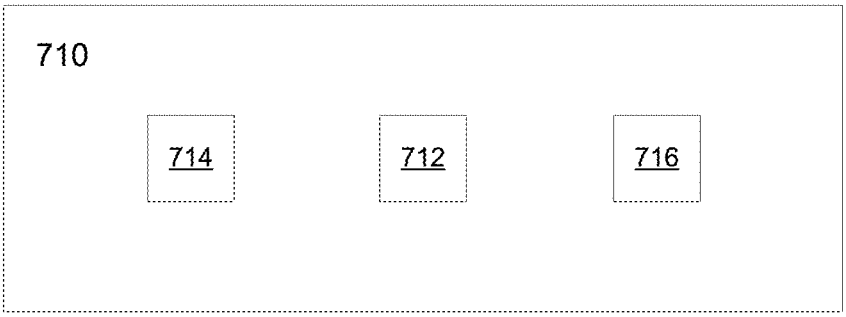

Referring to FIG. 7B, a second configuration of a fluid ejector 710 includes a jetting nozzle 712, a single inlet compliant nozzle 714, and a single outlet compliant nozzle 716. Both the inlet compliant nozzle 714 and the outlet compliant nozzle 716 are square and with the same dimensions. The crosstalk performance of the fluid ejector 710 was good, demonstrating that the presence of compliant nozzles 714, 716 can mitigate the effects of fluidic crosstalk. However, a large volume of fluid was lost through the compliant nozzles 714, 716 during priming.

Figure 7C:
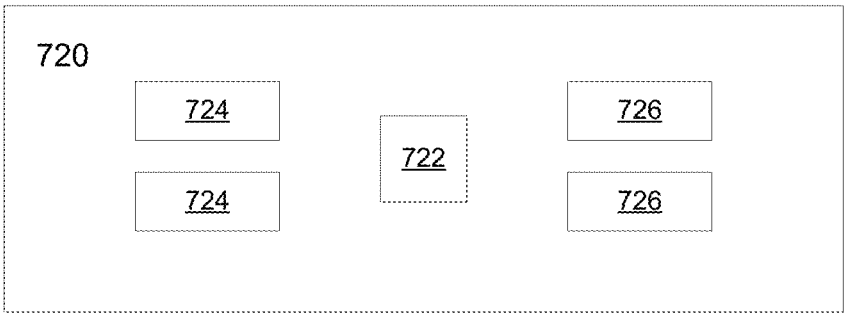

Referring to FIG. 7C, a third configuration of a fluid ejector 720 includes a jetting nozzle 722, two inlet compliant nozzles 724, and two outlet compliant nozzles 726. The inlet and outlet compliant nozzles 724, 726 are rectangular and have the same dimensions. The compliant nozzles 724, 726 are narrower in width and longer in length than the compliant nozzles 714, 716 of FIG. 7B, and thus have a higher bubble pressure than the compliant nozzles 714, 716. As expected given the higher bubble pressure, a smaller volume of fluid was lost through the compliant nozzles 724, 726 during priming. The crosstalk performance of the fluid ejector 720 was still good, demonstrating that rectangular compliant nozzles of this size can mitigate fluidic crosstalk.

Figure 7D:
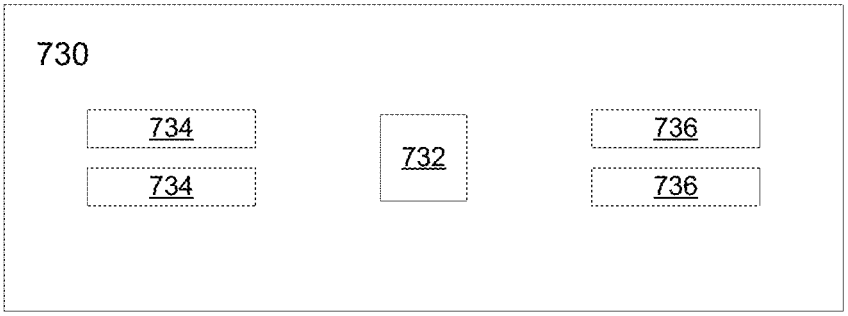

Referring to FIG. 7D, a fourth configuration of a fluid ejector 730 includes a jetting nozzle 732, two inlet compliant nozzles 734, and two outlet compliant nozzles 736. The inlet and outlet compliant nozzles 734, 736 are rectangular and have the same dimensions. The compliant nozzles 734, 736 are significantly narrower and longer than the compliant nozzles 724, 726 of FIG. 7C, and thus have a higher bubble pressure than the compliant nozzles 724, 726. Accordingly, a negligible volume of fluid was lost through the compliant nozzles 734, 736 during priming. However, the crosstalk performance of this fluid ejector was poor, indicating that the compliance lost by the narrowing of the nozzles was too much to be successfully offset by the increased length.

Figure 7E:
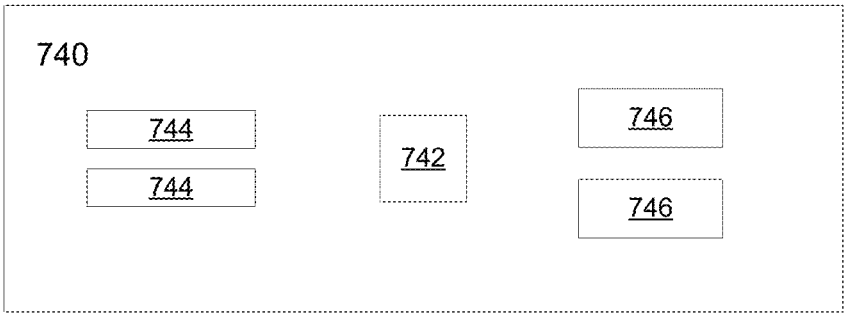

Referring to FIG. 7E, a fifth configuration of a fluid ejector 740 includes a jetting nozzle 742, two rectangular inlet compliant nozzles 744, and two rectangular outlet compliant nozzles 746. The inlet compliant nozzles 744 have a size that is similar to the size of the compliant nozzles 734 of FIG. 7D, which gives the inlet compliant nozzles 744 a high bubble pressure but a relatively low compliance. The outlet compliant nozzles 746 have a size that is similar to the size of the compliant nozzles 724 of FIG. 7C, and thus have a lower bubble pressure and higher compliance than the inlet compliant nozzles 744. That is, in the fluid ejector 740 of FIG. 7E, the bubble pressure of the inlet compliant nozzles 744 is greater than the bubble pressure of the outlet compliant nozzles 746, and the compliance is lower in the inlet feed channel than in the outlet feed channel. The fluid ejector 740 demonstrated both good crosstalk performance and negligible fluid loss during priming.

These results indicate that the geometry of inlet and outlet compliant nozzles can be tailored both to mitigate fluidic crosstalk and to reduce the fluid loss during priming.

Although these results demonstrate the performance of rectangular compliant nozzles, other shapes of compliant nozzles can also be used, such as round, oval, fractal, or other shapes.

In some examples, the distribution of the compliant nozzles can be adjusted to achieve desired crosstalk and/or fluid loss performance. For instance, the compliant nozzles can be distributed uniformly along the length of the feed channel, can be distributed randomly, or can be concentrated in one or more regions of the feed channel (e.g., the upstream end, the downstream end, or the middle of the feed channel). In some examples, the distribution of inlet and outlet compliant nozzles can be similar; in some examples, the distribution of inlet compliant nozzles can be different from the distribution of outlet compliant nozzles.

Figure 8:
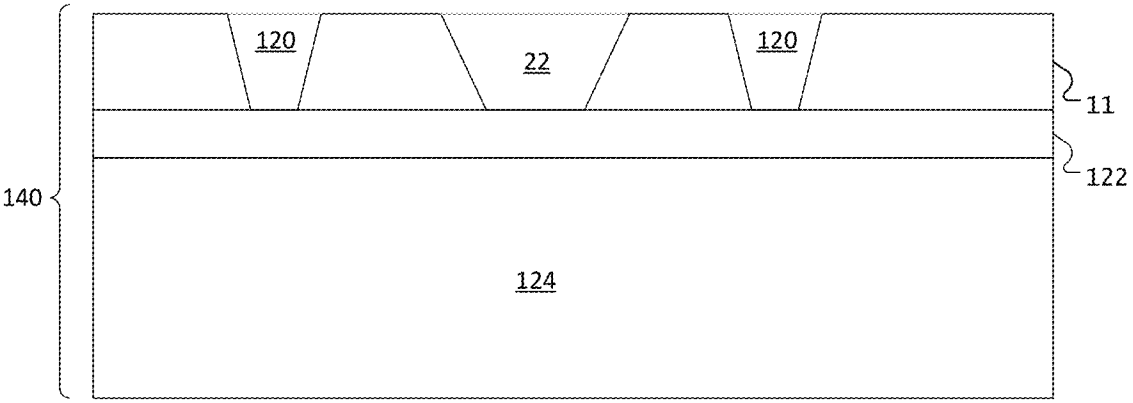
FIG. 8 is a diagram of fabrication of a fluid ejector.

FIG. 8 shows an example approach to fabricating fluid ejectors 150 having compliant nozzles 120 formed in the nozzle layer 11. A nozzle wafer 140 includes the nozzle layer 11, an etch stop layer 142 (e.g., an oxide or nitride etch stop layer, such as $SiO_2$ or $Si_3N_4$), and a handle layer 124 (e.g., a silicon handle layer). In some examples, the nozzle wafer 120 does not include the etch stop layer 122.

The jetting nozzles 22 and compliant nozzles 120 are formed through the nozzle layer 11, e.g., using standard microfabrication techniques including lithography and etching. In some implementations, the jetting nozzles 22 and compliant nozzles 120 are formed in the nozzle layer 11 at the same time, e.g., using the same etching step.

After formation of the jetting nozzles 22 and compliant nozzles 120, fabrication can proceed according to any of a variety of approaches to fabricating fluid ejectors.

Because the compliant nozzles 120 are formed during processing steps that would have occurred to form the jetting nozzles 22, there is little to no cost impact associated with forming the compliant nozzles 120.

In some examples, compliant microstructures can be membrane covered recesses, e.g., as described in U.S. application Ser. No. 14/695,525, filed Apr. 24, 2015, the contents of which are incorporated here by reference in their entirety. Membrane covered recesses in the inlet and outlet feed channels can be sized differently and/or can be different in number to achieve desired performance. These approaches can also be applied to other sources of compliance, such as trapped bubbles (e.g., MEMjet), internal compliances, or other sources of compliance.

Particular embodiments have been described. Other embodiments are within the scope of the following claims.

What is claimed is:

1. A fluid ejection apparatus comprising:

a fluid ejector comprising:

a pumping chamber, an ejection nozzle coupled to the pumping chamber, and an actuator configured to cause fluid to be ejected from the pumping chamber through the ejection nozzle;

a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber, wherein a compliance of the ejection nozzle is greater than a compliance of the first compliant assembly and a compliance of the second compliant assembly.

2. The fluid ejection apparatus of claim 1, in which the compliance of the first compliant assembly is less than the compliance of the second compliant assembly.

3. The fluid ejection apparatus of claim 1, wherein the first compliant assembly includes a first compliant nozzle and the second compliant assembly includes a second compliant nozzle.

4. The fluid ejection apparatus of claim 3, wherein the first compliant nozzle has a different size than the second compliant nozzle.

5. The fluid ejection apparatus of claim 4, in which a width of the first compliant nozzle is less than a width of the second compliant nozzle.

6. The fluid ejection apparatus of claim 4, in which a length of the first compliant nozzle is greater than a length of the second compliant nozzle.

7. The fluid ejection apparatus of claim 3, in which the ejection nozzle has a different size than a size of the first compliant nozzle, the second compliant nozzle, or both.

8. The fluid ejection apparatus of claim 3, wherein the first compliant assembly includes multiple first compliant nozzles and the second compliant assembly includes multiple second compliant nozzles.

9. The fluid ejection apparatus of claim 8, in which the number of first compliant nozzles is different from the number of second compliant nozzles.

10. The fluid ejection apparatus of claim 8, in which (i) the multiple first compliant nozzles are distributed non-uniformly on the surface of the inlet feed channel, (ii) the multiple second compliant nozzles are distributed non-uniformly on the surface of the outlet feed channel, or (iii) both (i) and (ii).

11. The fluid ejection apparatus of claim 3, wherein a shape of the first compliant nozzle is different from a shape of the second compliant nozzle.

12. The fluid ejection apparatus of claim 3, in which the first compliant nozzle defines an inner opening on an internal face of the surface of the inlet feed channel and an outer opening on an external face of the surface of the inlet feed channel; and the second compliant nozzle defines an inner opening on an internal face of the surface of the outlet feed channel and an outer opening on an external face of the surface of the outlet feed channel.

13. The fluid ejection apparatus of claim 1, comprising a restriction element formed in a surface of the inlet feed channel.

14. The fluid ejection apparatus of claim 1, in which the ejection nozzle is formed in a nozzle layer, and in which the nozzle layer comprises the surface of the inlet channel and the surface of the outlet channel.

15. A fluid ejection apparatus comprising:

a fluid ejector comprising:

a pumping chamber, an ejection nozzle coupled to the pumping chamber, and an actuator configured to cause fluid to be ejected from the pumping chamber through the ejection nozzle;

a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber, wherein a compliance of the first compliant assembly is different from a compliance of the second compliant assembly, and in which a bubble pressure of the first compliant assembly is greater than a bubble pressure of the ejection nozzle.

16. The fluid ejection apparatus of claim 15, wherein the first compliant assembly includes a first compliant nozzle and the second compliant assembly includes a second compliant nozzle.

17. The fluid ejection apparatus of claim 16, wherein the first compliant assembly includes multiple first compliant nozzles and the second compliant assembly includes multiple second compliant nozzles.

18. The fluid ejection apparatus of claim 16, wherein the first compliant nozzle has a different size than the second compliant nozzle.

19. The fluid ejection apparatus of claim 18, in which a width of the first compliant nozzle is less than a width of the second compliant nozzle.

20. The fluid ejection apparatus of claim 18, in which a length of the first compliant nozzle is greater than a length of the second compliant nozzle.

21. A fluid ejection apparatus comprising:

a fluid ejector comprising:

a pumping chamber, an ejection nozzle coupled to the pumping chamber, and an actuator configured to cause fluid to be ejected from the pumping chamber through the ejection nozzle;

a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber, wherein a compliance of the first compliant assembly is different from a compliance of the second compliant assembly, and in which a bubble pressure of the second compliant assembly is less than a bubble pressure of the ejection nozzle.

22. The fluid ejection apparatus of claim 21, wherein the first compliant assembly includes a first compliant nozzle and the second compliant assembly includes a second compliant nozzle.

23. The fluid ejection apparatus of claim 22, wherein the first compliant assembly includes multiple first compliant nozzles and the second compliant assembly includes multiple second compliant nozzles.

24. The fluid ejection apparatus of claim 22, wherein the first compliant nozzle has a different size than the second compliant nozzle.

25. The fluid ejection apparatus of claim 24, in which a width of the first compliant nozzle is less than a width of the second compliant nozzle.

26. The fluid ejection apparatus of claim 24, in which a length of the first compliant nozzle is greater than a length of the second compliant nozzle.

27. A fluid ejection apparatus comprising:

a fluid ejector comprising:

a pumping chamber, an ejection nozzle coupled to the pumping chamber, and an actuator configured to cause fluid to be ejected from the pumping chamber through the ejection nozzle;

a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber, wherein a compliance of the first compliant assembly is different from a compliance of the second compliant assembly, and wherein the first compliant assembly includes a first compliant nozzle and the second compliant assembly includes a second compliant nozzle, and in which a length of the first compliant nozzle is greater than a width of the first compliant nozzle.

28. The fluid ejection apparatus of claim 27, wherein the first compliant assembly includes a first compliant nozzle and the second compliant assembly includes a second compliant nozzle.

29. The fluid ejection apparatus of claim 28, wherein the first compliant assembly includes multiple first compliant nozzles and the second compliant assembly includes multiple second compliant nozzles.

30. The fluid ejection apparatus of claim 28, wherein the first compliant nozzle has a different size than the second compliant nozzle.

31. The fluid ejection apparatus of claim 30, in which a width of the first compliant nozzle is less than a width of the second compliant nozzle.

32. A fluid ejection apparatus comprising:

a fluid ejector comprising:

a pumping chamber, an ejection nozzle coupled to the pumping chamber, and an actuator configured to cause fluid to be ejected from the pumping chamber through the ejection nozzle;

a first compliant assembly formed in a surface of an inlet feed channel, the inlet feed channel fluidically connected to a fluid inlet of the pumping chamber; and a second compliant assembly formed in a surface of an outlet feed channel, the outlet feed channel fluidically connected to a fluid outlet of the pumping chamber, wherein a compliance of the first compliant assembly is different from a compliance of the second compliant assembly and wherein the first compliant assembly includes a first compliant nozzle and the second compliant assembly includes a second compliant nozzle, and in which the ejection nozzle has a different size than a size of the first compliant nozzle, the second compliant nozzle, or both, and in which a width of the ejection nozzle is greater than a width of the first compliant nozzle and a width of the second compliant nozzle, and in which a length of the ejection nozzle is less than a length of the first compliant nozzle and a length of the second compliant nozzle.

33. The fluid ejection apparatus of claim 32, in which the width of the first compliant nozzle is less than the width of the second compliant nozzle, and the length of the first compliant nozzle is greater than the length of the second compliant nozzle.

* * * * *